US005487402A

United States Patent [19]

Clary

[11] Patent Number: 5,487,402

[45] Date of Patent: Jan. 30, 1996

[54] PORTABLE SHELTER WITH EXPANDABLE FRAME

[75] Inventor: Michael S. Clary, P.O. Box 2544, Crystal River, Fla. 34423

[73] Assignees: Michael S. Clary; Cynthia G. Clary, both of Crystal River, Fla.

[21] Appl. No.: 289,014

[22] Filed: Aug. 11, 1994

[51] Int. Cl.[6] ..... E04H 15/04

[52] U.S. Cl. ..... 135/87; 135/90; 135/114; 135/117; 135/124; 135/139; 135/142; 135/900; 135/901; 135/119; 135/120.4; 52/83; 160/368.1

[58] Field of Search ..... 160/368.1; 135/87, 135/90, 114, 117, 121, 124, 139, 142, 144, 900, 901, 115, 119, 120.3, 120.4; 52/83

[56] References Cited

U.S. PATENT DOCUMENTS

| | | | |
|---|---|---|---|
| 1,081,699 | 12/1913 | Richling | 135/114 X |
| 2,027,984 | 1/1936 | Kapp | 135/120.3 X |
| 2,488,809 | 11/1949 | Denn . | |
| 2,646,057 | 7/1953 | Blanchard | 135/114 X |
| 2,685,353 | 12/1954 | Caskie | 135/114 X |
| 2,808,913 | 10/1957 | Frieder et al. . | |
| 2,897,831 | 8/1959 | Liden . | |
| 2,907,056 | 10/1959 | Kaplan | 135/117 X |
| 3,434,483 | 3/1969 | Topham | 135/87 X |
| 3,487,842 | 1/1970 | Larkin et al. | 135/87 X |
| 3,656,494 | 4/1972 | Cornett et al. . | |
| 4,084,598 | 4/1978 | Rainwater . | |
| 4,091,584 | 5/1978 | Brown . | |
| 4,597,401 | 7/1986 | Fournier | 135/90 |
| 4,685,484 | 8/1987 | Moneta | 135/900 X |
| 5,178,384 | 1/1993 | Gorman | 135/87 X |
| 5,263,468 | 11/1993 | Powell | 135/87 X |

FOREIGN PATENT DOCUMENTS

| | | | |
|---|---|---|---|
| 0474275 | 2/1915 | France | 135/90 |
| 0250561 | 9/1912 | Germany | 135/90 |
| 0050440 | 1/1910 | Switzerland | 135/90 |
| 0006580 | of 1890 | United Kingdom | 135/90 |
| 0527450 | 10/1940 | United Kingdom | 135/120.3 |

*Primary Examiner*—Wynn E. Wood
*Attorney, Agent, or Firm*—Pettis & McDonald

[57] ABSTRACT

A portable shelter having a frame whose members freely move between a maximum and a minimum dimension to enable selectively applying various sized shelter skins to the frame and to tauntly stretch the shelter skin thereon. The skin also comprises slidable tensioning means that stretch the skin over a portion of the frame. The upper portion of the shelter is partially supported by a lifting force applied thereto.

20 Claims, 5 Drawing Sheets

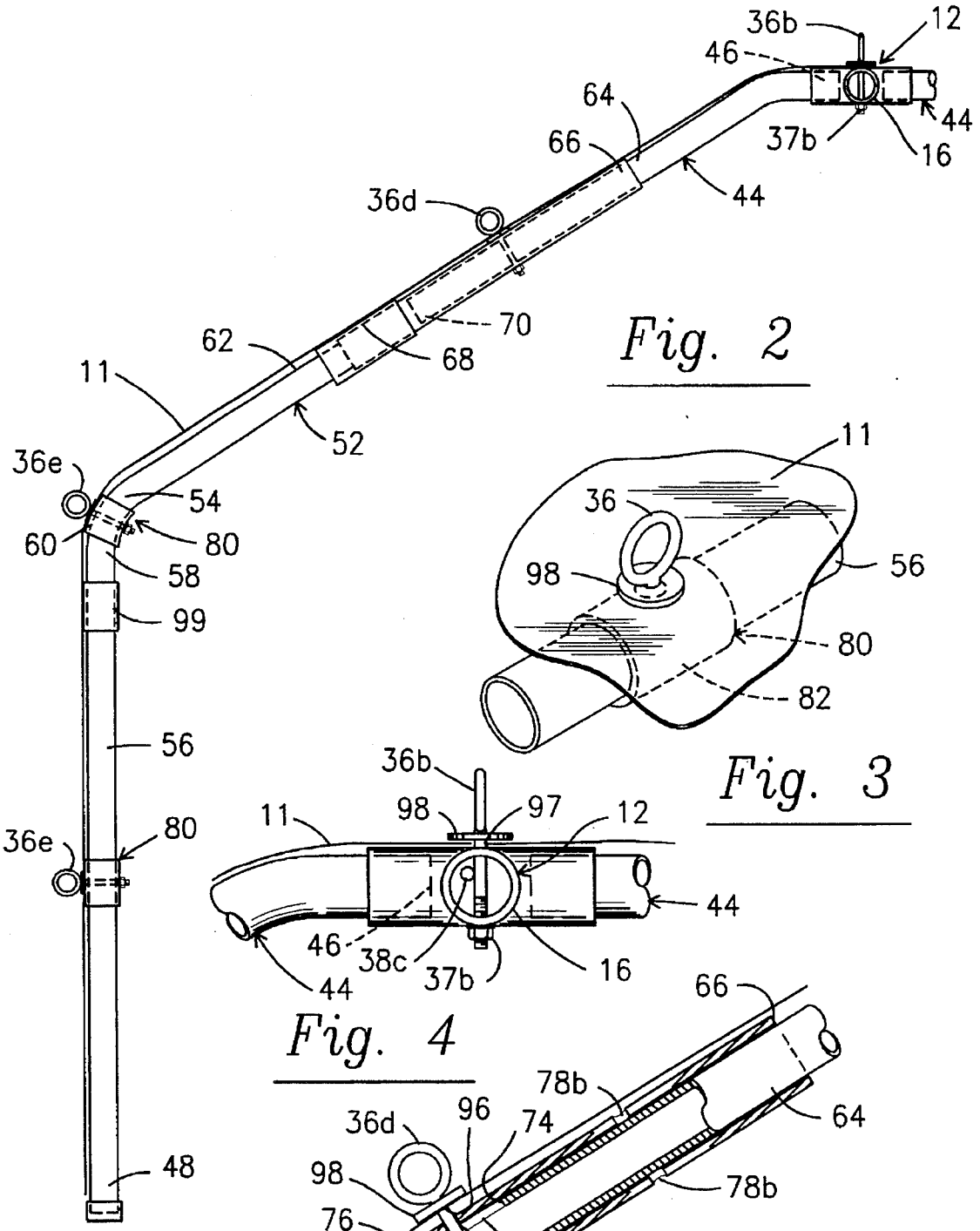
Fig. 2
Fig. 3
Fig. 4
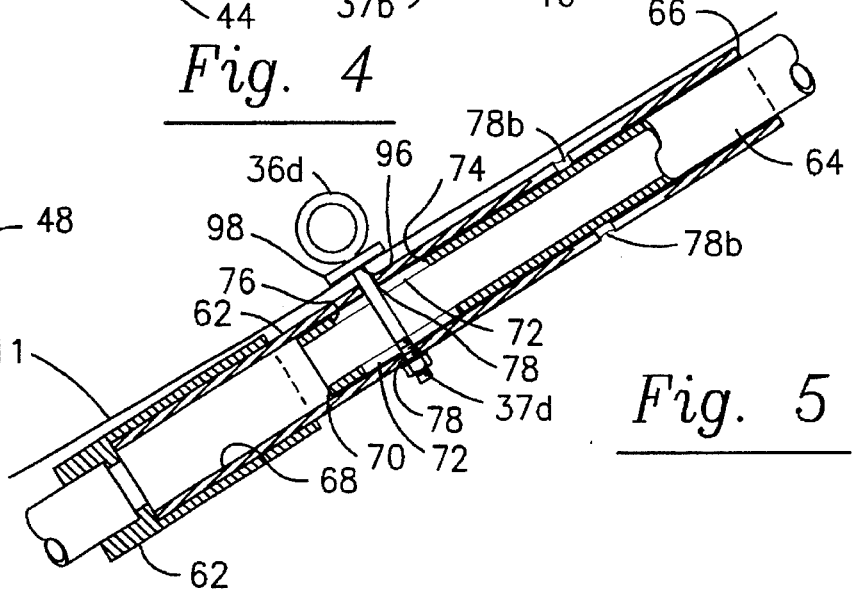
Fig. 5

PORTABLE SHELTER WITH EXPANDABLE FRAME

BACKGROUND OF THE INVENTION

1. Field of the Invention

The present invention relates to a portable shelter whose frame members expand and contract between maximum and minimum dimensions. This movement permits selectively applying various sized shelter skins to a single frame and provides flexible resistance to the forces of the wind against the portable shelter skin. Such structure also provides a means for tensioning the shelter skin to keep the skin taunt against the frame when wind forces are not present.

2. Description of the Prior Art

Portable shelters are well known in the art and include various structures from simple pup tents to larger and more complex shelters, for example circus tents. These portable shelters are constructed using frames that are generally rigid in the belief that rigidity is necessary to resist the forces of the wind against the shelter skin. Adjustability built into most portable shelters is primarily to ease assembly and to provide some limited stretching of the shelter skin. In many cases, the shelter skin extends from the shelter poles without structural support, being simply stretched as taunt as possible in order to maintain the interior space. Without structural support the shelter skin flaps and moves with the wind creating a collapsing and expanding interior space frequently to the discomfort of those occupying the shelter. In addition, strong winds striking shelters supported by rigid frames such as that disclosed by U.S. Pat. No. 2,897,831 issued to O. G. A. Liden, meet such resistance and lack of flexibility that the structures may collapse.

The current art requires that when portable shelters of different sizes are needed a new shelter must be obtained, including a new frame and a new skin. Another problem with proper fit occurs when shelter skins shrink in some areas and stretch in others so that they no longer properly fit frames that have fixed dimensions.

Notwithstanding the existence of such prior art, it remains clear that there is a need for a portable shelter having a frame that provides full support for a shelter skin in order to maintain the interior space and yet provides flexibility so that the portable shelter can flex and give in strong winds. There is a need for a portable shelter having a frame that provides structure for tightening the skin in relation to the frame to reduce the amount of flapping of the skin and to reduce sagging of the skin into the interior space. There is also a need for a frame that may be enlarged by extending the existing members of the frame or by adding new members, which only requires the purchase and storage of a larger skin.

SUMMARY OF THE INVENTION

The present invention relates to a portable shelter that has a frame that is flexible, expandable, and has structure for tensioning the shelter skin. The shelter frame fully supports the shelter skin so that the interior space is maintained. The shelter frame comprises a plurality of posts each having a first end and a second end. The first end of each post is connected to the first ends of the other posts and the second end of each post engages a support surface. A plurality of attaching means connects at least one of the posts to the support surface.

Each post comprises a rafter member having a first end and a second end, the first end including the first end of the post, and a leg member having a first end and a second end, whose second end includes the second end of the post. The second end of the rafter member is attached to the first end of the leg member to form a hip portion. Each rafter member comprises a first portion and a second portion with the second portion slideably engaging the first portion so that the rafter member is extendable between an extended position and a shortened position.

In a first embodiment the posts are connected to one another by being attached to a ridge pole. The ridge pole is comprised of at least one section which includes a first part and a second part. The second part of the section slideably engages the first part so that the ridge pole is extendable between an expanded position and a retracted position.

A lifting means is attached to the ridge pole and applies a lifting force thereto. The lifting force is angularly applied creating vertical and horizontal components of that force, the vertical component lifting the rafter and the horizontal component pulling the rafter ends longitudinally outwardly.

In another embodiment, the first ends of the posts are connected to one another by the skin of the shelter. In this embodiment, the lifting means is attached to the first end of at least one post.

The invention accordingly comprises an article of manufacture possessing the features, properties, and the relation of elements which will be exemplified in the article hereinafter described, and the scope of the invention will be indicated in the claims.

BRIEF DESCRIPTION OF THE DRAWINGS

For a full understanding of the nature and objects of the invention, reference should be had to the following detailed description taken in connection with the accompanying drawings, in which:

FIG. 2 is an end view of a pair of posts of the invention of FIG. 1 with one of the posts broken away and illustrating the shelter skin attached thereto.

FIG. 3 is a perspective detailed view of a leg tensioning means of FIG. 2 illustrating the shelter skin attached thereto.

FIG. 4 is a detailed view of the ridge pole of FIG. 2.

FIG. 5 is a detailed sectional view of the rafter of FIG. 2 illustrating the means for extending the rafter.

Similar reference characters refer to similar parts throughout the several views of the drawings. Different embodiments utilize reference numbers increased in increments of 100 for identification of similar parts.

DETAILED DESCRIPTION

Figures 6, 7, 8:
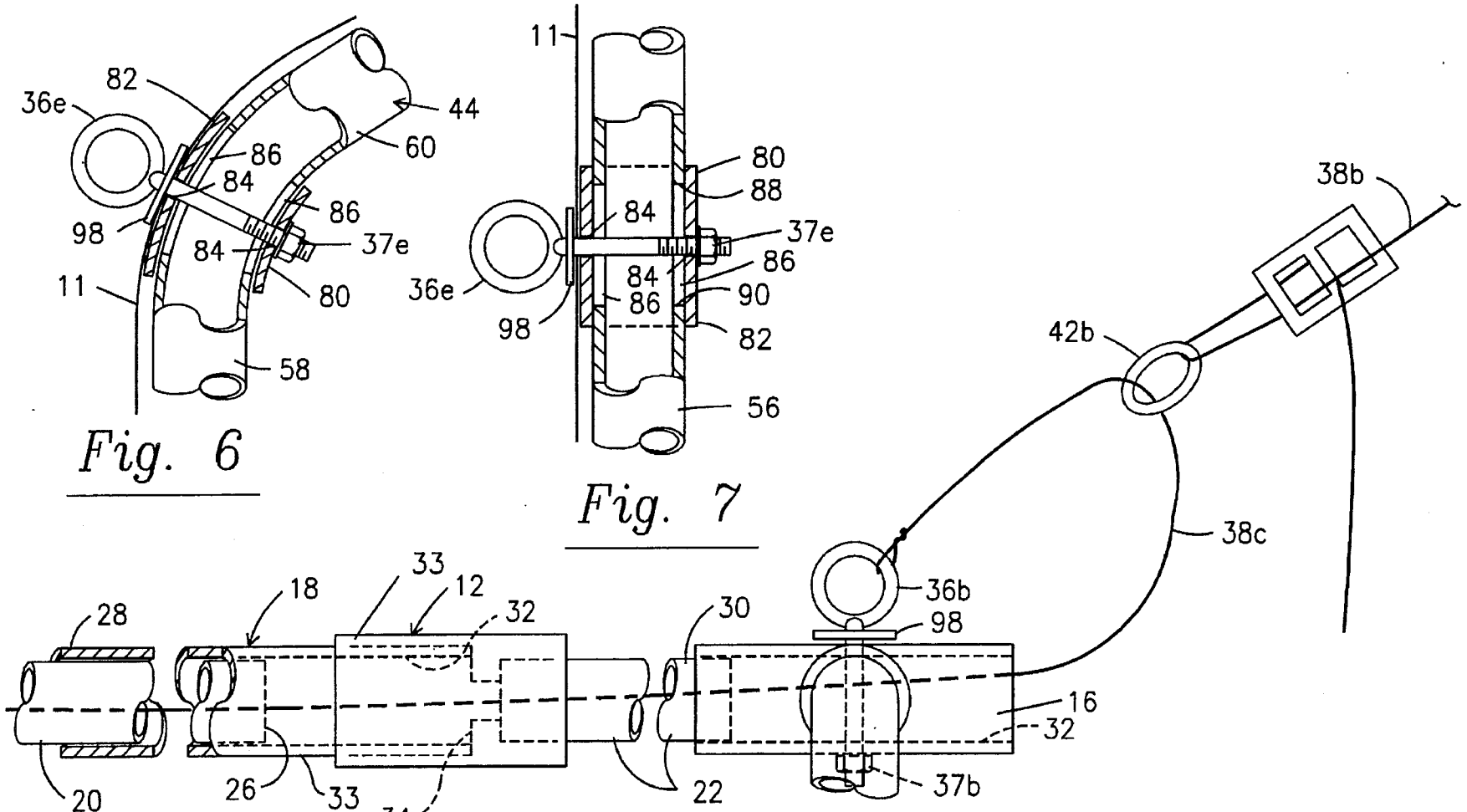
FIG. 6 is a detailed sectional view of the hip portion of the invention of FIG. 2 illustrating a means for tensioning the skin attached thereto.
FIG. 7 is a detailed sectional view of the leg tensioning means of FIG. 2.
FIG. 8 is a detailed sectional view of the ridge pole of FIG. 1 with portions broken away for convenience.

A preferred embodiment for the portable shelter of this invention is illustrated in the drawing FIGS. 1–8 and is generally indicated as 1. The portable shelter 1 comprises a frame 10 and a skin 11 that is mounted thereon. The frame is includes a ridge pole 12 that has a first end 14 and a second end 16. The ridge pole comprises at least one section 18; however, in the embodiment illustrated in FIG. 1 the ridge pole 12 comprises two sections 18. Each section 18 comprises a first part 20 and a second part 22 that extend between two pair of posts as discussed further below. As best seen in FIG. 8, the first part 20 has a first end 24 and a second end 26 and the second part 22 has a first end 28 and a second end 30. The ridge pole 12 has a bore 32 therethrough that extends from the first end 14 to the second end 16. In a preferred embodiment illustrated in FIG. 1, the bore 32 proximal the first end 28 of the second part 22 is enlarged to form an enlarged portion 33 that is sized to receive the second end 26 of first part 20. The first end 26 is allowed to freely move inwardly and outwardly within the enlarged bore 33 of the second part 22 extending the ridge pole 12 between a fully expanded position and a retracted position. The fully expanded position is defined as the position of the ridge pole 12 just before the first end 26 of the first part 20 disengages from the enlarged portion 33 of the second part 22 in each section 18. The fully retracted position is defined as the position of the ridge pole 12 when the first end 26 engages the stop 34 in each section 18.

The length of the enlarged portion 33 is based upon the desired expansion for a particular sized shelter. For example, a 12 foot by 16 foot shelter frame 10 having two sections 18, is preferably sized to extend to a 14 foot by 20 foot shelter. Thus, each enlarged portion 33 of the second part 22 extends 2½ feet so that it can receive approximately 2½ feet of first part 20 in the retracted position. The ridge pole 12, in the retracted position, is approximately 16 feet long and when each section 18 is moved to the expanded position the ridge pole 12 extends to at least 20 feet. This is but one configuration, many other sizes of portable shelters 1 with predetermined expansion capability may be made using the teachings of this invention.

The ridge pole 12 of the shelter frame 10 may be comprised of a plurality of sections to create a shelter 1 of greater overall length. Each section 18 may comprise a first part 20 and a second part 22 which slidably engage one another for extension of that section 18. Other configurations may comprise sections 18 that are not extendable, that is sections 18 that do not have first and second parts 20 and 22 respectively. In the preferred embodiment illustrated in FIG. 1, two sections are provided and each section 18 is comprised of extendable parts 20 and 22.

Figure 1:
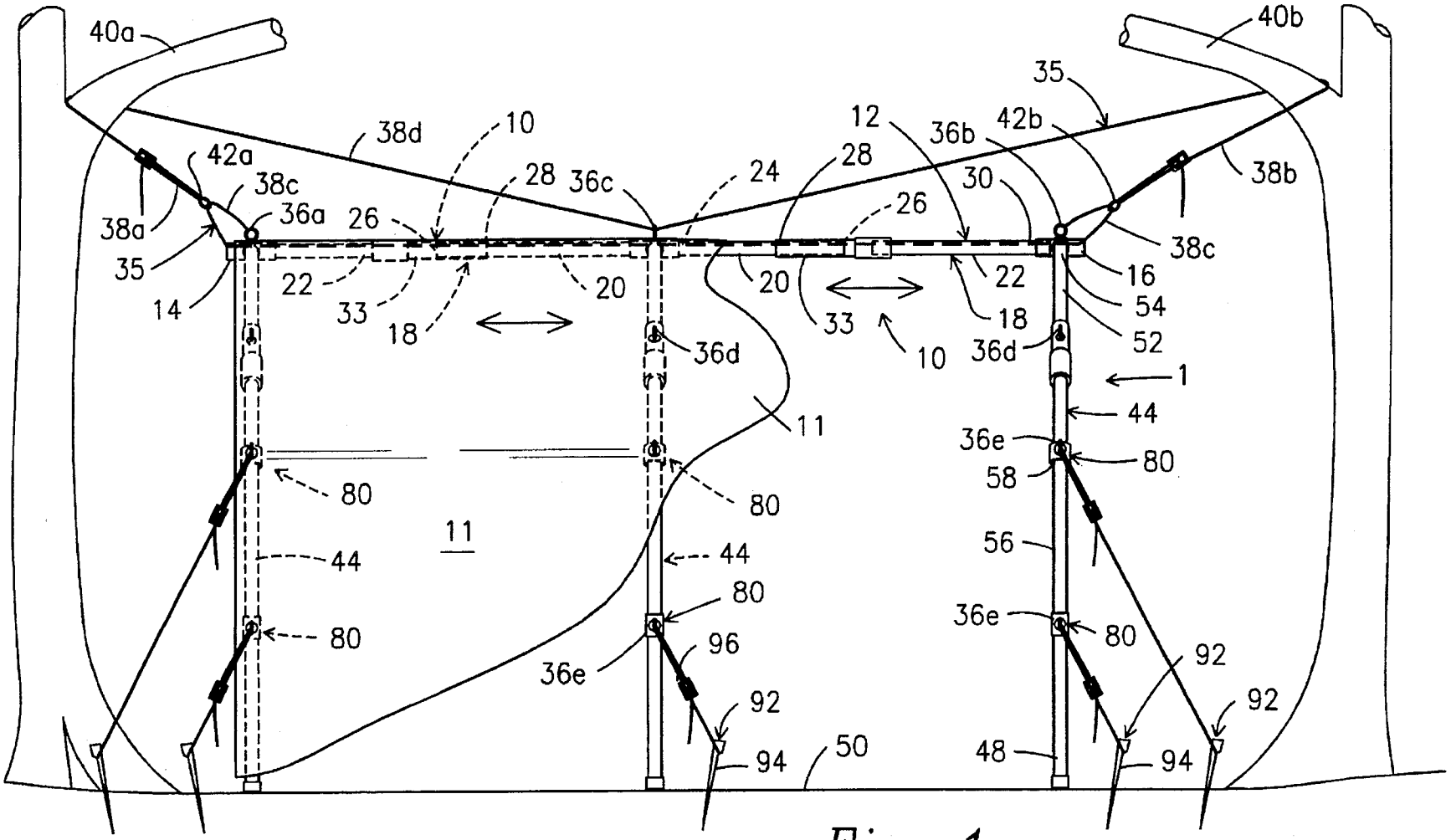
FIG. 1 is a side elevational view of the portable shelter frame of this invention illustrating the shelter skin mounted thereon, a portion of which is broken away to better view the shelter frame.

A lifting means 35 is attached to the ridge pole 12 to provide a lifting force in support of the ridge pole 12. The lifting means 35 comprises joining means, conveniently eye bolts 36*a* and *b* with nuts 37*a* (not shown) and 37*b* respectively threaded thereto, and a plurality of first, second, third, and fourth lines, 38*a*, 38*b*, 38*c*, and 38*d*, respectively attach the eye bolts 36*a*, 36*b*, and 36*c* to a support means, conveniently trees 40, as shown in FIG. 1. Line 38*a* at one end is connected to eye bolt 36*a* and at the other end is connected to a portion of the tree 40*a* that lies in a horizontal plane above the ridge pole so that an upward force is applied to the ridge pole by the line 38*a*. Line 38*a* extends upwardly and outwardly, in relation to the frame 10, at an angle less than 90 degrees; therefore, the force comprises vertical and lateral components that are each applied to the ridge pole 12. One end of line 38*b* is connected to the eye bolt 36*b* and the other end is attached to a tree 40*b* to also apply a lifting force to the ridge pole 12 that has both vertical and lateral components extending outwardly from the shelter 1. One end of a third line 38*c* is attached to eye bolt 36*a* and the other end extends through the bore 32 of the ridge pole 12 and is attached to eye bolt 36*b*. A ring 42*a* is placed on line 38*c* adjacent to the eye bolt 36*a* and line 38*a* is attached to the ring 42*a*. Similarly, at the other end of the ridge pole 12, a ring 42*b* is placed about the line 38*c* adjacent the eye bolt 36*b* so that the line 38*b* may be attached thereto and thus be connected to eye bolt 36*b*. The rings 42*a* and 42*b* permit movement of the ridge pole 12 along line 38*c*, particularly during the expansion and contraction movement of the ridge pole 12. To provide additional lifting support to the ridge pole 12, a linking means, conveniently eye bolt 36*c*, is attached to the ridge pole 12 intermediate the first end 14 and second end 16 of the ridge pole 12, preferably to the center of the ridge pole 12 between the two sections 18. A fourth line 38*d* extends from a point on tree 40*a*, that is above the ridge pole 12 through eye bolt 36*c* to a point in the second tree 40*b*, which is also above the ridge pole 12. As can be seen in FIG. 1, lines 38*a*, 38*b*, and 38*d* may be a single line which extends from the ring 42*a* to the tree 40*a* through the eye bolt 36*c* to the tree 40*b* and to the ring 42*b* or they may be individual lines tied individually to the trees 40. In the embodiment illustrated in FIG. 1, two trees 40 that are spaced apart from one another comprise the support means; however, any convenient support means may be used, including but not limited to a single large tree, a pair of poles that extend above the shelter frame 10 or large vehicles parked adjacent to the shelter frame 10.

A plurality of posts 44 each have a first end 46 that is connected to the ridge pole 12 and a second end 48 that engages a support surface 50, which in FIG. 1 is illustrated as being the surface of the ground. In a preferred embodiment as illustrated in FIG. 1, the posts 44 are attached to one another in opposing pairs at the end of each section 18 and between the sections 18. The shelter frame 10 may be erected on wooden platforms, concrete slabs or any other convenient surface. As illustrated in FIG. 2, each post 44 is comprised of a rafter member 52, having a first end coinciding with the first end 46 of the post 44 and a second end 54. Each post 44 further comprises a leg member 56 having a first end 58 and a second end that coincides with the second end 48 of the post 44. The first end 58 of the leg 56 is attached to the second end 54 of the rafter 52 to form a hip portion 60 where the rafter member 52 forms an angle with the leg member 56. Each rafter member 52 is comprised of a first rafter portion 62 and a second rafter portion 64 that slidably engages the first rafter portion 62 so that the rafter member 52 is extendable between an extended position and a shortened position. In the embodiment disclosed in FIG. 1 and FIG. 2, the first end 66 of the first rafter portion 62 has a bore 68 therein which is sized to receive the first end 70 of the second rafter portion 64. As seen in the detail in FIG. 5, the second rafter portion 64 has an elongated aperture 72 therethrough that has a first end 74 and a second end 76. The first rafter portion 62 has a port 78 therethrough which is aligned with aperture 72 when the second rafter portion 64 is inserted in the bore 68 of the first rafter portion 62. A rafter eye bolt 36*d* is inserted through the port 78 and the aperture 72 and is attached loosely to the rafter member 52 by nut 37*d*. Pulling on the second rafter portion 64 extends the rafter member 52 until the rafter eye bolt 36*d* engages the second end 76 of the aperture 72, which is defined as the extended position. When the second rafter portion 64 is pushed inwardly into the first rafter portion 62, the second end 74 of the aperture engages the rafter eye bolt 36*d*, which defines the shortened position. Additional ports, for example port 78*b* may be provided through the second rafter portion 62 to increase the maximum length of the rafter member 52.

The length of the bore 68, as in the ridge pole 12, is determined by the desired expansion needed to create a particular sized shelter 1. For example, a 12 foot by 16 foot shelter is preferably sized to extend to a 14 foot by 20 foot shelter. Thus, each rafter must be extendable for more than 1 foot (due to the angle of the rafters) to enable the shelter to be extended from 12 to 14 feet. Therefore, the bore is generally two (2) feet in length so that it can receive approximately two (2) feet of the first end 70 of the second rafter portion 64 in the shortened position (12 foot wide). A pair of posts 44 extend across the support surface 50 approximately twelve (12) feet in the shortened position, and approximately fourteen (14) feet when each rafter member 52 is moved to the extended position. As mentioned previously, this is but one configuration as many other sizes of portable shelters 1 with predetermined expansion capability may be made using the teachings of this invention.

As seen in FIG. 1 and FIG. 2, the portable shelter frame comprises a plurality of tensioning means 80 with at least one of the tensioning means slidably attached to at least one of the posts 44. In the embodiment disclosed in FIG. 1 and FIG. 2, it can be seen that two tensioning means 80 are attached to each post 44. One of the tensioning means 80 is attached to leg member 56 intermediate the first end 58 and the second end 48 and a second tensioning means 80 is attached adjacent the hip portion 60. As best seen in FIG. 7, the tensioning means 80 on the leg member 56 comprises a sleeve 82 having a hole 84 therethrough which is aligned with a slot 86 that is formed through the leg member 56 so that a sleeve eye bolt 36*e* may be inserted through the hole 84 and the slot 86 and be attached firmly to the sleeve 82 by nut 37*e*. The sleeve 82 is free to slide upon the leg member 56 until the sleeve eye bolt 36*e* engages one end of the slot 88, defining the first position, or engages the other end of the slot 90 defining the second foot position. The slot 86 in a preferred embodiment, for a 12×18 shelter 1, is generally three (3) inches long; however any length suitable for the size of shelter 1 may be used.

FIG. 6 illustrates a tensioning means 80 attached adjacent to the hip 60 which is configured identically with the tensioning means that is attached to the leg as illustrated in FIGS. 7 with one exception. The sleeve 82 is curved so that it may slide upon the curved hip portion 60. In a preferred embodiment, the curvature is approximately 60 degrees; however, since any reasonable curvature may be used to form the hip portion 60 a sleeve only need to approximately match that curvature so that it will freely slide upon the hip portion 60 of the post 44.

A plurality of attaching means 92 are used to attach the posts 44 to the support surface 50. In the embodiment disclosed in FIG. 1 in which the support surface 50 comprises the earth, the attaching means comprises a stake 94 with a cord 96 that is attached to the stake 94 at one end and to a sleeve eye bolt 36*e* at the other end.

The frame 10 for a shelter 1 may be provided to fit existing shelter skins or an appropriately sized skin 11 may be provided with the particular frame offered. The shelter skin 11 may be made of any suitable water resistant or water proof material well known in the art. The skin is prepared as shown in FIG. 4, with holes 97 through the skin 11 to receive all the eye bolts 36 therethrough. Each hole 97 is placed in the skin 11 so that the sleeve eye bolt 36*e* are generally at the mid point of the slots 86 of the tensioning means 80 when the skin 11 is generally taunt and at the appropriate points to receive the rafter eye bolts 36*d* in the rafters 52 and the eye bolts 36*a–c* in the ridge pole 12, which depends largely upon the size of the skin being used.

Figure 9:
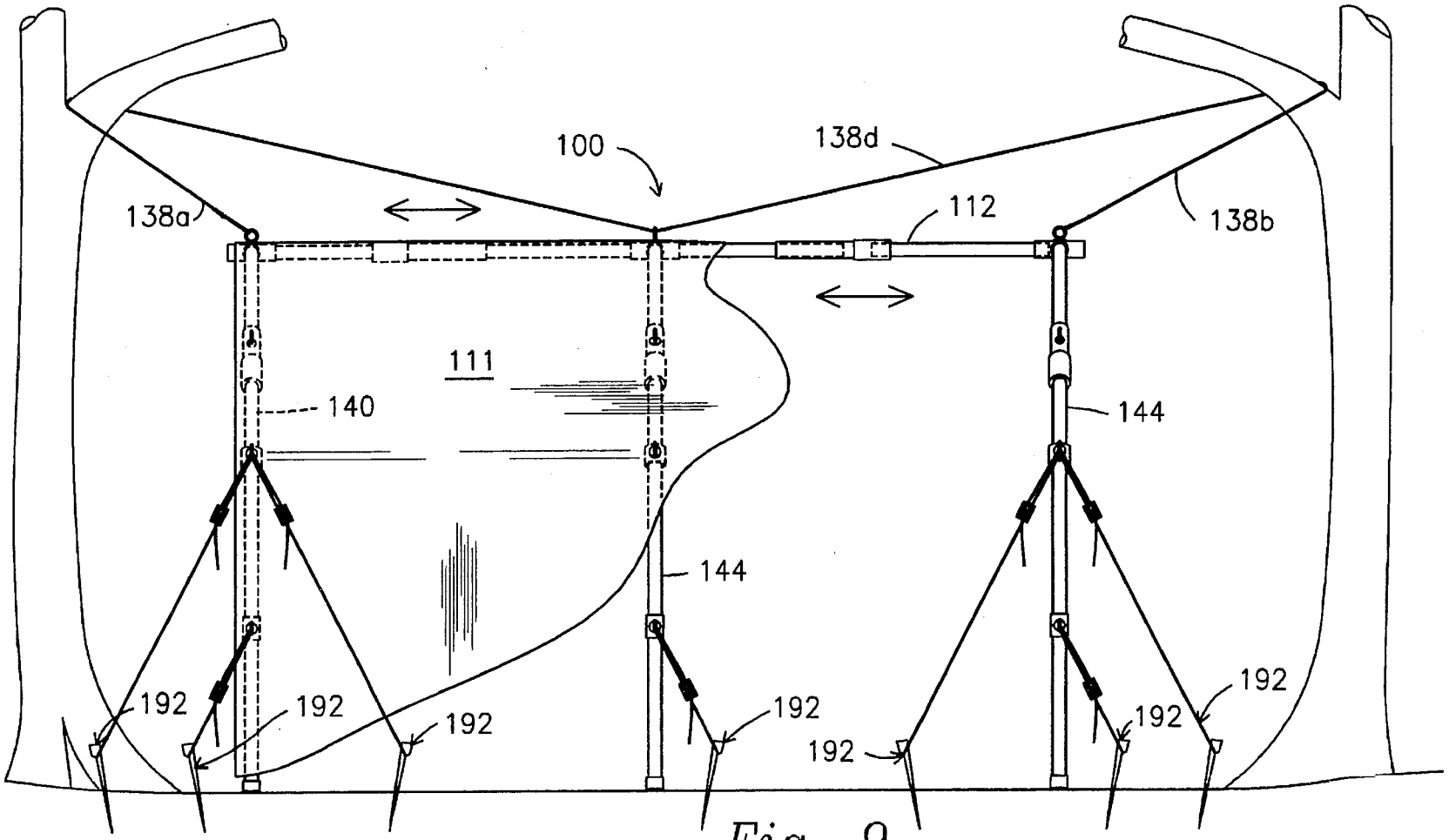
FIG. 9 is a side elevational view of a second embodiment of the invention of FIG. 1.

FIG. 9 discloses a second embodiment 100 of the invention of FIG. 1, in which the line 138*c* is not utilized. The skin 111 limits the expansion of the ridge pole 112.

Figure 10:
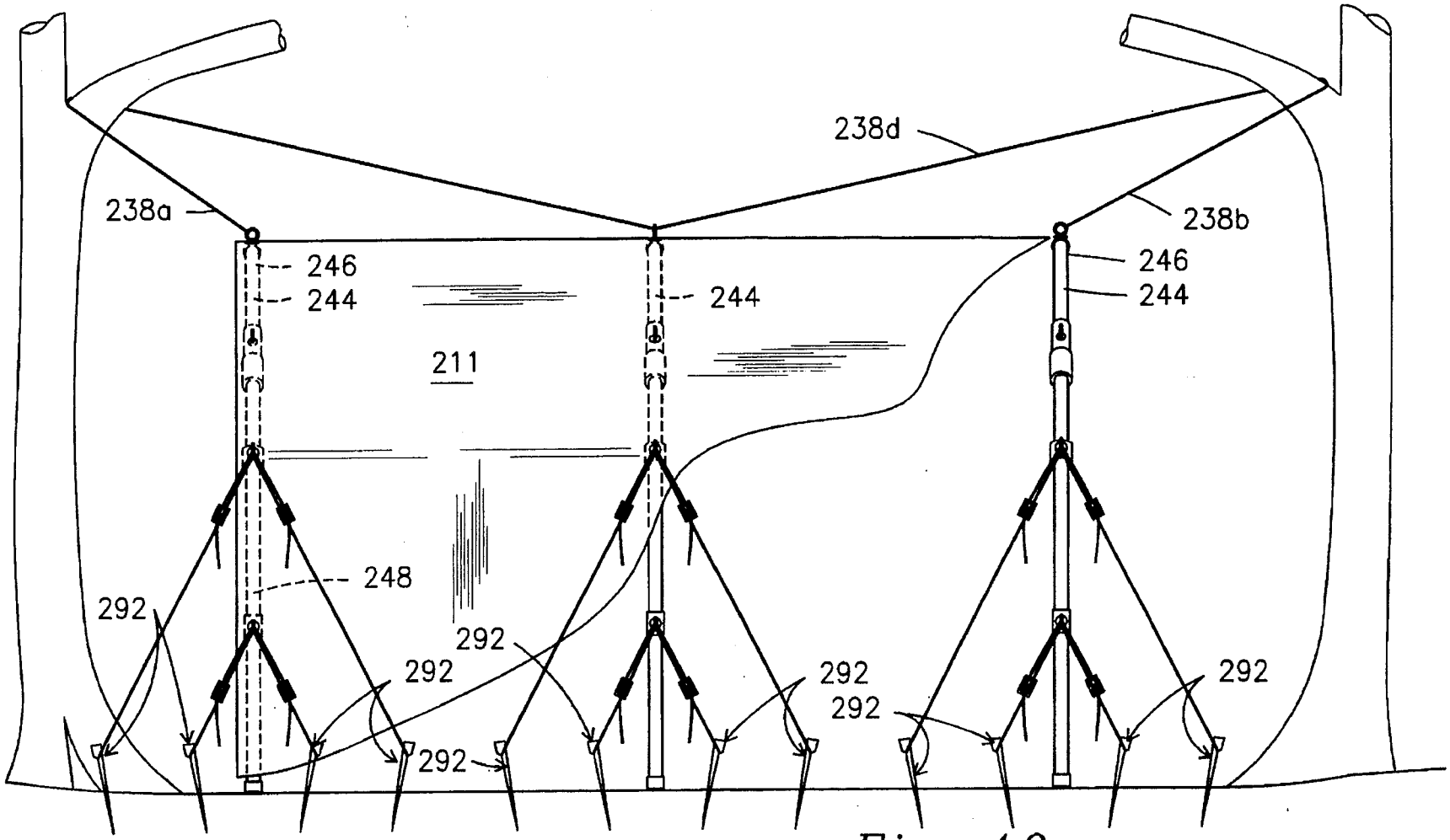
FIG. 10 is a side elevational of a third embodiment of the invention of FIG. 1.

FIG. 10 discloses a third embodiment 200 of the portable shelter which comprises at least two pair of posts 244. Each post 244 having a first end 246 and a second end 248. The first ends 246 of each pair of posts are attached to one another and the second ends 248 engage the support surface 250. In this embodiment there is no ridge pole 212, but the remainder of the structure of each post 244 is the same as the structure in the other embodiments of the invention. Each pair posts 44 are spaced apart from the other pairs of posts 44. Without the ridge pole 212 the pairs of posts 44 are held in place by the attaching means 292 and the skin 211 when mounted thereon. Additionally, there is no line 238*c* as the lines 238*b* and 238*a* are attached directly to the eye bolts 236*b* and 236*a*, respectively, which are attached to the first ends 246 of the posts 244.

The portable shelter frame in each of the preferred embodiments disclosed is comprised of Poly Vinyl Chloride (PVC) piping which is selected to support a particular sized portable shelter. For example, a 12 by 16 portable shelter 1 having three pairs of posts 44 as disclosed in FIG. 1 will be constructed of schedule 40 PVC piping having an outside diameter of approximately 1 and ¼0 inches and a thickness of approximately 3/16ths of an inch. Of course, any other material suitable for the purpose may be substituted for PVC, including but not limited to aluminum, wood, steel, or any other suitable synthetic resin. When using PVC plastic piping material standard fittings that are well known in the art are used to connect the various parts of the portable shelters 1, 100, and 200. When using other materials connectors suitable for that purpose that are well known in the art are used to make the connections, including but not limited to, providing sleeving with bolted connections or other disassembleable attaching means for easy assembly and disassembly. The PVC piping is held in the fittings by a friction fit so that the frame 10 may easily be disassembled for portability and storage.

Having thus set forth a preferred construction for the portable shelter 1 of this invention, it is to be remembered that this is but a preferred embodiment. Attention is now invited to a description of the use of the portable shelter 100 and 200.

As mentioned previously the assembly of the portable shelter 1 requires adjacent structures to which a line may be attached to provide a lifting force to the upper portion of the shelter 1. When in the woods, trees may be easily located which are sufficiently spaced apart to provide the necessary support; however, when the portable shelter 1 must be assembled in an area without trees separate posts, not shown, are used to provide the necessary support similar to that provided by a tree. Once a suitable site is located a ridge pole is stretched upon the ground to fit the size of skin 11 being used. The skin 11 is then placed over the ridge pole 12 so that the eye bolts 36*a*, 36*b*, and 36*c* may be passed through a washer 98, the skin 11 and the ridge pole 12 with a nut 37 being attached to the bolt to hold the skin 11 to the ridge pole 12. Line 38*c* is inserted through bore 32 and then attached at one end to eye bolt 36*a* and at the other end to eye bolt 36b with rings 42a and 42b located proximal to the respective eye bolts 36a and 36b. Lines 38a and 38b are then attached to the respective rings 42a and 42b with the other ends of the lines being attached to a point in a tree that will be above the expected height of the shelter 1. The first end 46 of each rafter 52 is then attached to the ridge pole 12. The skin 11 is then stretched over the rafter members 52 and attached thereto by the rafter eye bolts 36d and the sleeve eye bolts 36e of the tensioning means at the hip portion 60. Lines 38a and 38b are then shortened raising the ridge pole and rafters above the support surface 50 so that the remaining portion of the legs 56 may be easily attached to the legs and rafters by the coupling 99. Once the legs 56 are in place the lines 23a and 23b are again tightened applying a lifting force so that the ridge pole 12 is longitudinally stretched to match the length of the ridge of the skin 11 removing wrinkles from the skin 11. In addition, line 38b is tightened to reduce any sag in the middle of the ridge pole. The vertical element of the lifting force extends the rafters from the shortened position toward the extended position as necessary to remove wrinkles in the skin 11.

The attaching means 92, in the embodiment disclosed in FIG. 1, comprises a stake 94 and cord 96 which are attached individually to each tensioning means 80. As the cord 96 is tightened the sleeve eye bolts 36e move downwardly along the slot 86 stretching the skin 11 between rafter eye bolt 36d and sleeve eye bolt 36e at the hip 60 and between the tensioning means 80 at the hip 60 and the tensioning means on the leg 56. The bottom of the skin is then tightened by staking (not shown) or by placing the skin under the ends 48 of the legs 56 and attaching them to a ground cloth (not shown).

The portable shelter is now assembled with the skin 11 stretched smoothly over the frame 10. Assembled in this manner, when the wind blows the ridge pole 12 will give inwardly as the first part 20 slides inwardly into the second part 22. In addition, the ridge pole will slide upon line 38d on eye bolt 36c providing additional increasing resistance through the wind as the eye bolt 36c moves up the line 38d. When the wind subsides the frame 10 returns to its original position. As the skin 11 is tauntly applied to the frame 10, little flapping of the skin 11 occurs, providing a stable and clear area on the interior of the portable shelter 1.

Now that the invention has been described,

What is claimed is:

1. A portable shelter erectable on a support surface, said shelter comprising:

a frame further comprising;

a ridge pole, having a first end and a second end, said ridge pole further comprising at least one section, said section comprising a first part and a second part, said second part slideably engaging said first part such that said ridge pole is extendable between an expanded position and a retracted position;

a plurality of posts, each said post having a first end attached to said ridge pole and a second end engaging a support surface; and a lifting means comprising a first joining means attached to said first end of said ridge pole and a second joining means attached to said second end of said ridge pole; a first line having a first end connected to said first joining means and having a second end attached to a first support means at a point in a horizontal plane that lies above said ridge pole; a second line having a first end connected to said second joining means and having a second end attached to a second support means at a point in a horizontal plane that lies above said ridge pole, the first support means being spaced apart from the second support means, whereby a lifting force is applied to said ridge pole.

2. A portable shelter as in claim 1 wherein said first part and said second part of said ridge pole each have a first end and a second end and said first end of said second part has a bore therein sized to slideably receive said second end of said first part and a portion of said first part therein.

3. A portable shelter as in claim 1 wherein said ridge pole has a bore therethrough, and said lifting means further comprises a third line having a first end and a second end, said line being inserted in said bore such that said first end of said line is attached to said first joining means and said second end of said line is attached to said second joining means, said first end of said first line being slideably attached to said third line proximal said first end of said third line and said second line being slideably attached to said third line proximal said second end of said third line.

4. A portable shelter as in claim 1 wherein said lifting means further comprises a linking means attached to said ridge pole intermediate said first end and said second end of said ridge pole, and a fourth line having a first end and a second end, said fourth line slideably attached to said linking means, said first end of said fourth line being attached to a first support means at a point in a horizontal plane higher than said ridge pole and said second end of said fourth line being attached to a second support means at a point in a horizontal plane higher than said ridge pole and said second support means being spaced apart from said first support means, whereby a lifting force is applied to said ridge pole.

5. A portable shelter as in claim 1 wherein each said post comprises a rafter member having a first end and a second end and a leg member having a first end and a second end, said rafter member including said first end of said post and said leg including said second end of said post, said second end of said rafter member being attached to said first end of said leg member to form a hip portion, each said rafter member having a first rafter portion and a second rafter portion, said second rafter portion slideably engaging said first rafter portion such that said rafter member is extendable between an extended position and a shortened position.

6. A portable shelter as in claim 5 wherein said second rafter portion of said rafter member has an elongated aperture therethrough having a first longitudinal end and a second longitudinal end, said first rafter portion of said rafter member has a bore therein sized to slideably receive said second end of said first rafter portion and a part of said first rafter portion therein, said first rafter portion having a port therethrough aligned with said aperture, and a rafter eye bolt passing through said port and said aperture, whereby said rafter eye bolt engages said first end of said aperture when said rafter member is in said extended position and said rafter eye bolt engages said second end of said aperture when said rafter member is in said shortened position; and said shelter further comprising a shelter skin having a plurality of openings therethrough mounted on said frame such that said openings receive said rafter eye bolts therethrough attaching said skin to said frame.

7. A portable shelter as in claim 1 wherein said shelter further comprises a plurality of tensioning means, at least one of said tensioning means slidably attached to at least one of said posts for movement therealong between a first position and a second position, each said tensioning means adapted for attachment to a shelter skin; and a plurality of attaching means, one of said attaching means attaching a respective said tensioning means to said support surface.

8. A portable shelter as in claims 7 wherein each said post has a at least one slot therethrough, each slot having two ends and wherein said tensioning means comprises a sleeve slideably mounted on said post, said sleeve having a hole therethrough aligned with said slot in said post, and a sleeve eye bolt passing through said hole and said slot, whereby said sleeve eye bolt and said sleeve slide on said post from said first position, where said sleeve eye bolt engages one end of said slot, to said second position, where said sleeve eye bolt engages the other end of said slot.

9. A portable shelter as in claim 7 wherein each said post further comprises a rafter member having a first end and a second end and a leg member having a first end and a second end, said rafter member including said first end of said post and said leg member including said second end of said post, said second end of said rafter member being attached to said first end of said leg member to form a hip portion, two tensioning means of said plurality of tensioning means being attached to at least one post, one of said two tensioning means attached to said post adjacent said hip portion and the other attached to said post intermediate said first end and said second end of said leg member.

10. A portable shelter erectable on a support surface, said shelter comprising:

a plurality of posts, each post having a first end connected to a first end of the other posts of said plurality of posts, and said second end of each said post engaging a support surface, at least one said post has at least one slot therethrough, said slot having two ends;

at least one tensioning means, slidably attached to at least one of said posts said slot allowing movement therealong between a first position and a second position, said tensioning means comprising a sleeve slideably mounted on said at least one of said posts, said sleeve having a hole therethrough aligned with said slot in said post, and a sleeve eye bolt passing through said hole and said slot, whereby said sleeve eye bolt and said sleeve slide on said post from said first position, where said sleeve eye bolt engages one end of said slot, to said second position, where said sleeve eye bolt engages the other end of said slot, each said tensioning means attached to a shelter skin; and a plurality of attaching means, one of said attaching means attaching a respective said tensioning means to said support surface.

11. A portable shelter as in claim 10 wherein each said post further comprises a rafter member having a first end and a second end and a leg member having a first end and a second end, said rafter member including said first end of said post and said leg member including said second end of said post, said second end of said rafter member being attached to said first end of said leg member at an angle to form a hip portion, two tensioning means of said plurality of tensioning means being attached to at least one post, one of said two tensioning means attached to said post adjacent said hip portion and the other attached to said post intermediate said first end and said second end of said leg member.

12. A portable shelter as in claim 10 wherein each said post comprises a rafter member having a first end and a second end and a leg member having a first end and a second end, said rafter member including said first end of said post and said leg including said second end of said post, said second end of said rafter member being attached to said first end of said leg member to form a hip portion, each said rafter member having a first rafter portion and a second rafter portion, said second rafter portion slideably engaging said first rafter portion such that said rafter member is extendable between an extended position and a shortened position.

13. A portable shelter as in claim 12 wherein said second rafter portion of said rafter member has an elongated aperture therethrough having a first longitudinal end and a second longitudinal end, said first rafter portion of said rafter member has a bore therein sized to slideably receive said second end of said first rafter portion and a part of said first rafter portion therein, said first rafter portion having a port therethrough aligned with said aperture, and a rafter eye bolt passing through said port and said aperture, whereby said rafter eye bolt engages said first end of said aperture when said rafter member is in said extended position and said rafter eye bolt engages said second end of said aperture when said rafter member is in said shortened position; and said shelter further comprising a shelter skin having a plurality of openings therethrough mounted on said frame such that said openings receive said rafter eye bolts therethrough attaching said skin to said frame.

14. A portable shelter erectable on a support surface, said shelter comprising:

a frame, said frame further comprising; at least two pairs of posts, each post having a first end, said first ends of each said pair of posts being attached to one another, each post having a second end engaging a support surface; each said post comprising a rafter member having a first end and a second end and a leg member having a first end and a second end, said rafter member including said first end of said post and said leg including said second end of said post, said second end of said rafter member being attached to said first end of said leg member at an angle to form a hip portion, each said rafter member having a first rafter portion and a second rafter portion, said second rafter portion slideably engaging said first rafter portion such that said rafter member is extendable between an extended position and a shortened position;

a lifting means connected to said first ends of said posts, whereby a lifting force is applied to said posts; and a plurality of attaching means, at least one of said attaching means attaching each pair of said posts to said support surface.

15. A portable shelter as in claim 14 wherein shelter further comprises a plurality of eye bolts attached to said frame and a skin mounted over said frame, said skin having openings therethrough for receiving said eye bolts therethrough attaching said skin to said frame.

16. A portable shelter as in claim 14 wherein said second rafter portion of said rafter member has an elongated aperture therethrough having a first longitudinal end and a second longitudinal end, said first rafter portion of said rafter member has a bore therein sized to slideably receive said second end of said first rafter portion and a part of said first rafter portion therein, said first rafter portion having a port therethrough aligned with said aperture, and a rafter eye bolt passing through said port and said aperture, whereby said rafter eye bolt engages said first end of said aperture when said rafter member is in said extended position and said rafter eye bolt engages said second end of said aperture when said rafter member is in said shortened position.

17. A portable shelter as in claim 14 wherein said frame further comprises a plurality of tensioning means, at least one of said tensioning means slidably attached to at least one of said posts for movement therealong between a first position and a second position, each said tensioning means adapted for attachment to a shelter skin; and a plurality of attaching means, one of said attaching means attaching a respective said tensioning means to said support surface.

18. A portable shelter as in claim 17 wherein each said post has a at least one slot therethrough, each slot having two ends and wherein said tensioning means comprises a sleeve slideably mounted on said post, said sleeve having a hole therethrough aligned with said slot in said post, and a sleeve eye bolt passing through said hole and said slot, whereby said sleeve eye bolt and said sleeve slide on said post from said first position, where said sleeve eye bolt engages one end of said slot, to said second position, where said sleeve eye bolt engages the other end of said slot.

19. A portable shelter as in claim 17 wherein each said post further comprises a rafter member having a first end and a second end and a leg member having a first end and a second end, said rafter member including said first end of said post and said leg member including said second end of said post, said second end of said rafter member being attached to said first end of said leg member to form a hip portion, two tensioning means of said plurality of tensioning means being attached to at least one post, one of said two tensioning means attached to said post adjacent said hip portion and the other attached to said post intermediate said first end and said second end of said leg member.

20. A portable shelter as in claim 14, wherein said lifting means comprises a first joining means attached to said first end of said ridge pole and a second joining means attached to said second end of said ridge pole; a first line having a first end connected to said first joining means and said line being attached to a first support means at a point in a horizontal plane that lies above said ridge pole, a second line having a first end connected to said second joining means and said line being attached to a second support means at a point in a horizontal plane that lies above said ridge pole, the first support means being spaced apart from the second support means.

* * * * *